US009586084B2

(12) United States Patent
Duke

(10) Patent No.: US 9,586,084 B2
(45) Date of Patent: Mar. 7, 2017

(54) EXERCISE ROCKING CHAIR

(71) Applicant: John Hincks Duke, Providence, RI (US)

(72) Inventor: John Hincks Duke, Providence, RI (US)

( * ) Notice: Subject to any disclaimer, the term of this patent is extended or adjusted under 35 U.S.C. 154(b) by 0 days.

(21) Appl. No.: 14/997,473

(22) Filed: Jan. 15, 2016

(65) Prior Publication Data

US 2016/0206910 A1 Jul. 21, 2016

Related U.S. Application Data

(60) Provisional application No. 62/103,581, filed on Jan. 15, 2015, provisional application No. 62/116,898, filed on Feb. 16, 2015.

(51) Int. Cl.

| | |
|---|---|
| ***A63B 21/06*** | (2006.01) |
| ***A47C 9/00*** | (2006.01) |
| ***A63B 21/068*** | (2006.01) |
| ***A47C 3/029*** | (2006.01) |
| ***A63B 23/12*** | (2006.01) |
| *A63B 21/00* | (2006.01) |
| *A63B 71/00* | (2006.01) |
| *A63B 21/02* | (2006.01) |
| *A63B 23/02* | (2006.01) |
| *A63B 21/04* | (2006.01) |

(52) U.S. Cl.

CPC ..... *A63B 21/4047* (2015.10); *A47C 3/029* (2013.01); *A47C 9/002* (2013.01); *A63B 21/00072* (2013.01); *A63B 21/068* (2013.01); *A63B 21/4035* (2015.10); *A63B 23/1209* (2013.01); *A63B 21/00178* (2013.01); *A63B 21/00185* (2013.01); *A63B 21/00196* (2013.01); *A63B 21/023* (2013.01); *A63B 21/0421* (2013.01); *A63B 23/0205* (2013.01); *A63B 71/0054* (2013.01); *A63B 2208/0233* (2013.01); *A63B 2210/02* (2013.01)

(58) Field of Classification Search

USPC ..... 482/1–148

See application file for complete search history.

(56) References Cited

U.S. PATENT DOCUMENTS

| | | | | | |
|---|---|---|---|---|---|
| 524,279 | A | | 8/1894 | Kottmann | |
| 5,104,181 | A | | 4/1992 | Lange | |
| 5,423,731 | A | * | 6/1995 | Chen | A63B 21/4047 482/130 |
| 5,466,191 | A | * | 11/1995 | Chang | A63G 15/00 280/1.175 |

(Continued)

*Primary Examiner* — Stephen Crow

(57) ABSTRACT

A rocking chair provides abdominal exercise by user actuation of pivotal armrest handles that are configured to provide a crunch type exercise motion. The arrangement of internal pivot frames is such that armrest handle actuation shifts the user's center of mass both vertically and longitudinally, which in turn initiates a natural rocking motion by gravity. The inertial dynamics of the resulting motion are inherently kinesthetically pleasurable. The resistance is provided by the user's own body weight with variation through differential leverage. Alternatively, the configuration of the armrest handles is such that a user may benefit from an isometric exercise by simply holding them stationary in a conventional armrest position.

6 Claims, 4 Drawing Sheets

(56) References Cited

U.S. PATENT DOCUMENTS

| | | | | | |
|---|---|---|---|---|---|
| 5,547,443 | A * | 8/1996 | Chen | A63B 21/068 | 482/121 |
| 5,577,987 | A | 11/1996 | Brown | | |
| 5,595,558 | A | 1/1997 | Moon | | |
| 5,851,166 | A * | 12/1998 | Bernardson | A63B 22/16 | 482/79 |
| 5,897,462 | A | 4/1999 | St. Germain | | |
| 6,213,923 | B1 | 4/2001 | Cameron et al. | | |
| 6,761,671 | B1 | 7/2004 | McKinney et al. | | |
| 6,855,098 | B2 | 2/2005 | Reitz et al. | | |
| 7,094,188 | B2 * | 8/2006 | Reitz | A63B 23/035 | 482/142 |
| 7,572,190 | B2 * | 8/2009 | Habing | A63G 11/00 | 472/110 |
| 8,100,475 | B2 | 1/2012 | Habing | | |
| 8,469,449 | B2 * | 6/2013 | Kao | A47C 1/029 | 297/258.1 |
| 8,870,720 | B1 * | 10/2014 | Webber | A63B 21/00181 | 482/100 |
| 2016/0206910 | A1 * | 7/2016 | Duke | A47C 3/029 | |

* cited by examiner

EXERCISE ROCKING CHAIR

1. BACKGROUND OF THE INVENTION

Present research in exercise physiology demonstrates the value for sedentary people in low intensity exercise undertaken for long periods of time. To this end, there is now an increase in work time at stand-up desks, and personal electronic fitness tracking devices now record cumulative hours spent walking and standing to meet motivational goals. A broad objective of the present invention is therefore to provide a comfortable means for individuals to benefit from low intensity exercise, and to provide this benefit in a way that is easily integrated into their existing lifestyles to facilitate long duration use.

Abdominal core strength is a fitness capability that is important for maintenance of mobility and prevention of back injury. A particular objective of the present objective is therefore to provide abdominal exercise while sitting, which may be combined with other long duration activities such as watching television, reading an e-book with automatic page turning, or working at a computer with voice activated commands.

In the prior art, a popular abdominal exerciser suitable for home or office use is a sit-up device such as disclosed in U.S. Pat. No. 5,577,987 to D. Brown and U.S. Pat. No. 7,074,165 to K. Hodge et al. However, use of this type of device requires laying on a floor, which cannot be performed concurrently with other long duration activities. Other popular abdominal exercise products such as the Tony Little Ab Lounge Xtreme are effective but too intense for long duration use and are also incompatible with other user activities.

The present invention is a low elevation rocking chair that an individual may be comfortable sitting in whether or not its exercise function is used. Fitness rocking chairs in the prior art include a rocking glider disclosed in U.S. Pat. No. 524,279 to J. Kottmann and U.S. Pat. No. 6,761,671 to W. McKinney and R. Barnes, but these are leg actuated, so do not engage the upper body muscles of a crunch type motion. Other non-rocking exercise chairs include U.S. Pat. No. 5,595,558 to D. Moon, U.S. Pat. No. 6,213,923 to W. Cameron et al., and U.S. Pat. No. 6,855,098 to A. Reitz et al., but these do not benefit from the inherent satisfaction of a natural rocking rhythm.

In the present invention, the armrests of the chair are configured to pivot in a way that provides a crunch type exercise motion. The resistance is provided by the user's own body weight with variation through differential leverage. A particular advantage is that armrest handle actuation also shifts the user's center of mass longitudinally, which in turn initiates a natural rocking motion by gravity. Because the seat height is low enough, this motion may also be opposed by negative leg resistance. The inertial dynamics of the resulting motion are inherently kinesthetically pleasurable. Alternatively, the configuration of the armrest handles is such that a user may benefit from an isometric exercise by simply holding them stationary in a conventional armrest position.

2. BRIEF DESCRIPTION OF THE DRAWINGS

3. SPECIFICATION

A rocking chair provides abdominal exercise by user actuation of pivotal handles. The chair has a forward end in the user facing direction, a left side facing forward, a right side facing forward, and a rear end.

Figure 1:
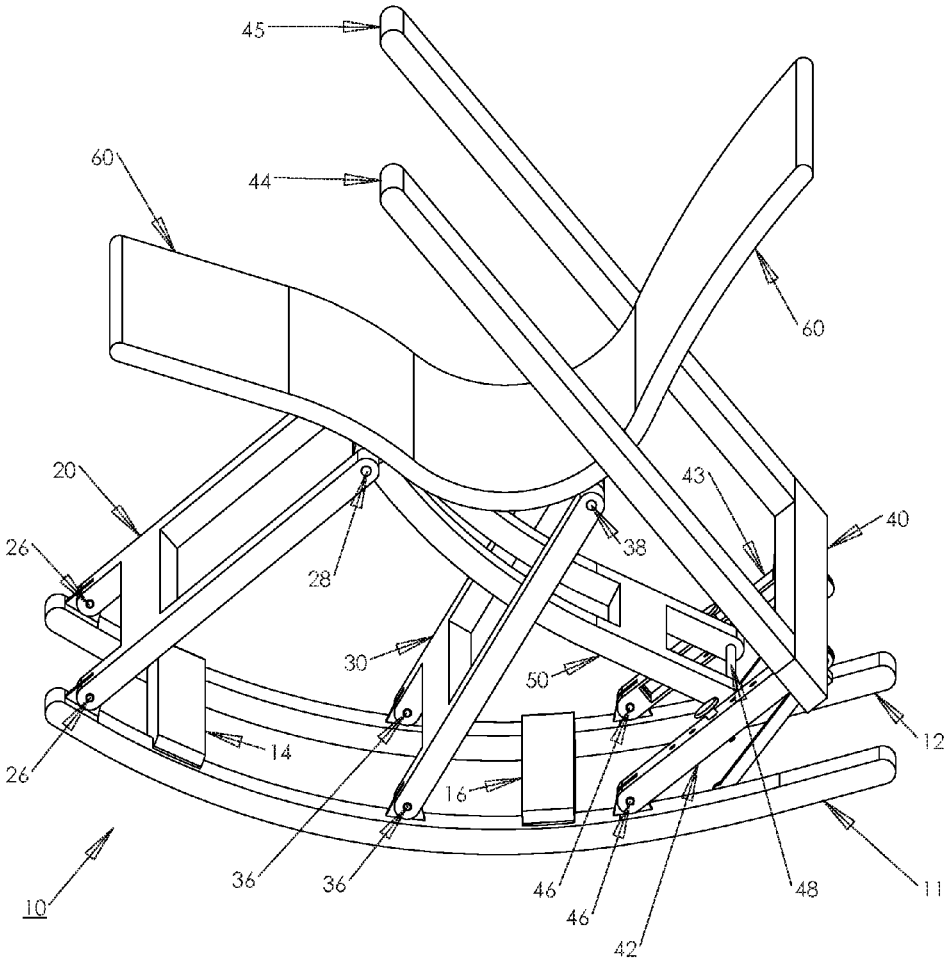
FIG. 1 is a perspective side view of the chair in an intermediate handle position and an intermediate resistance setting.

In FIG. 1, a rocker base 10 is comprised of a left rocker 11 and a right rocker 12, a forward spacer 14 that connects the forward ends of rockers 11 and 12 and a central spacer 16 that connects the central portions of rockers 11 and 12. The lower end of a forward support frame 20 connects to the forward ends of rockers 11 and 12 by rotation about dowel pins that define an axis 26. The lower end of a central support frame 30 connects to the central portion of rockers 11 and 12 by rotation about dowel pins that define an axis 36. A actuator frame 40 is comprised of a left lever 42 and a right lever 43 and a left handle 44 and a right handle 45. The lower ends of levers 42 and 43 respectively connect to the rear portions of rockers 11 and 12 by rotation about dowel pins that define an axis 46. A push frame 50 has a lower end that connects to levers 42 and 42 by rotation about a shaft that defines an axis 48. The location of axis 48 with respect to axis 46 on levers 42 and 42 is user-changeable as further described below. The axis 48 position shown in FIG. 1 provides intermediate resistance to user actuation. The angle of actuator frame 40 with respect to rocker base 10 shown in FIG. 1 is an intermediate angle of handle 44 and 45 actuation. Push frame 50 projects through an open portion of central support frame 30. A seat 60 has a forward portion that connects to both the upper end of forward support frame 20 and the upper end of push frame 50 by rotation about a shaft that defines an axis 28. The rear portion of seat 60 connects to the upper end of central support frame 30 by rotation about a shaft that defines an axis 38.

Figure 2:
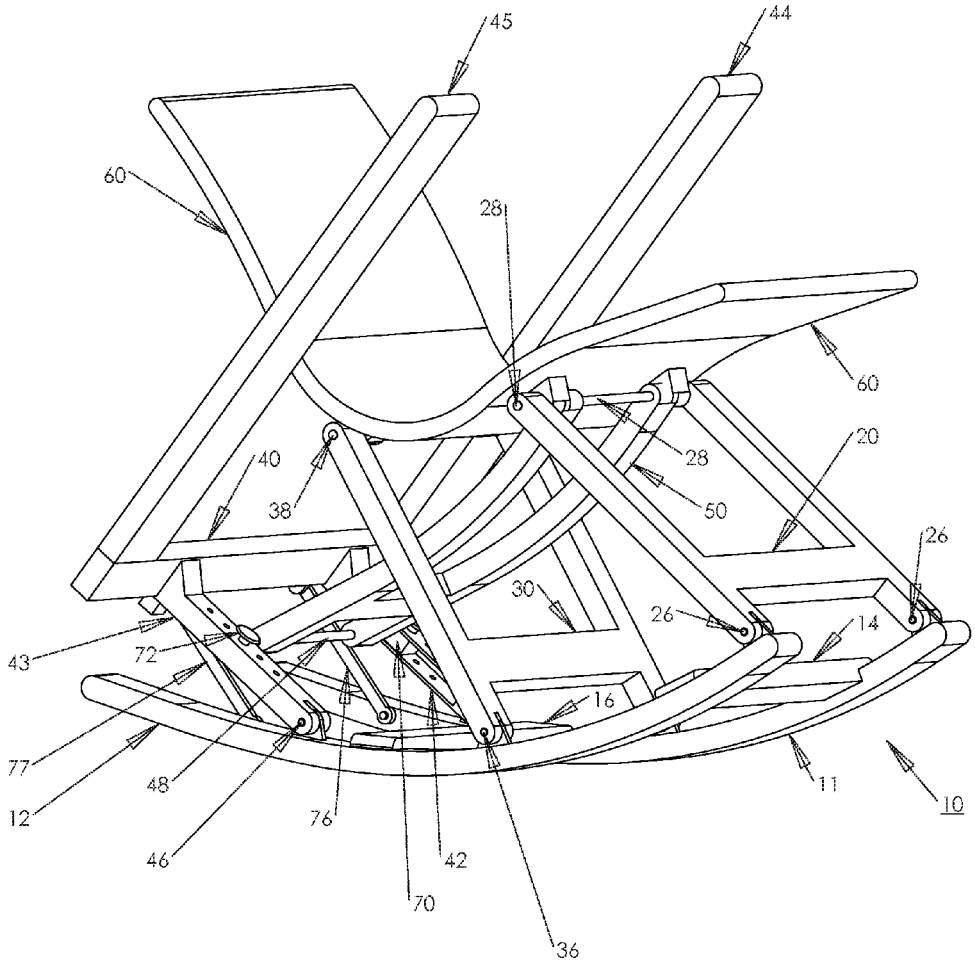
FIG. 2 is a perspective front quarter view of the chair in an intermediate handle position and an intermediate resistance setting.

FIG. 2 is a front perspective view of the chair in the FIG. 1 position that further shows one of a pair of blocks 70 that may slide within levers 42 and 43 and support the ends of the axis 48 shaft. One of a pair of user-retractable pins 72 secures blocks 70 within levers 42 and 43 at a user-selectable hole positions. A left spring 76 and a right spring 77 provide torque in rear frame 40.

Figure 3:
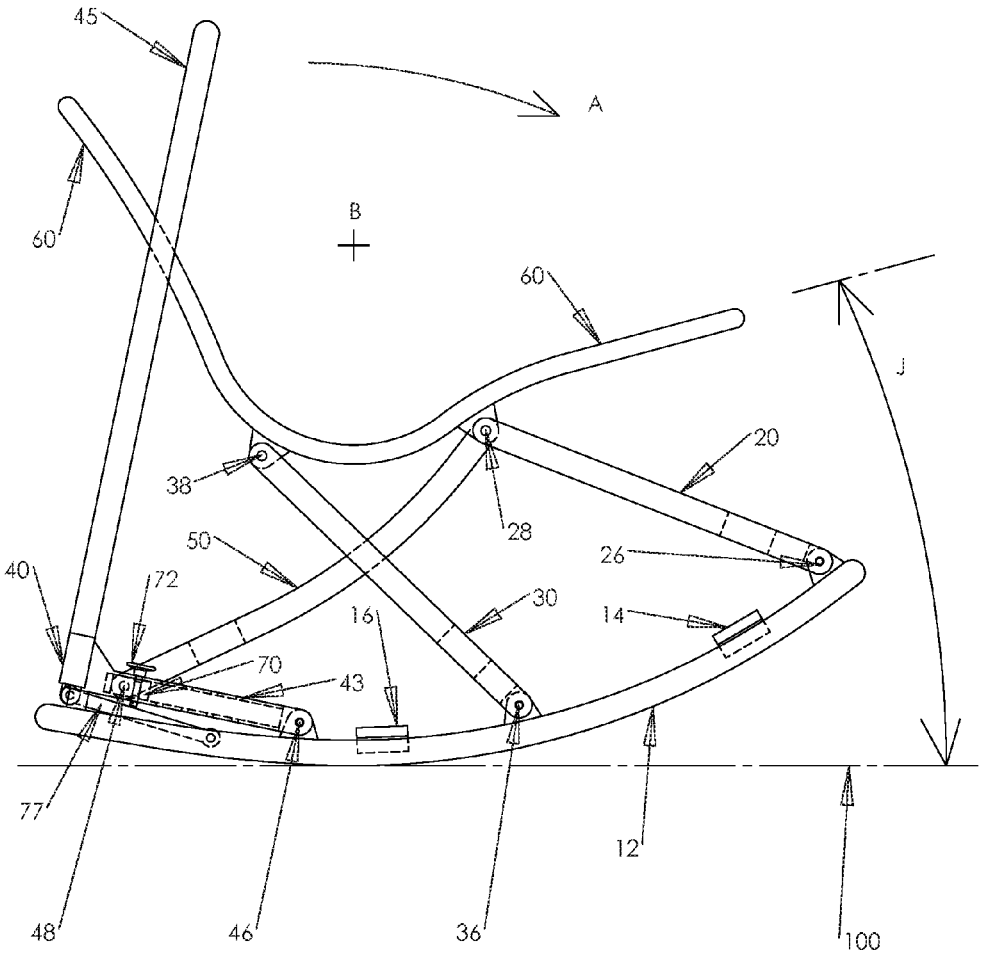
FIG. 3 is a transparent side plan view of the chair in an initial no-load position and a maximum resistance setting.

FIG. 3 is a transparent side elevation view with the chair in an initial static no-load position with an axis 48 position that provides maximum resistance to user actuation. Springs 76 and 77 act to rotate actuator frame 40 towards the no-load position of FIG. 3. An arc A indicates a first direction of handles 44 and 45 actuation that rotates actuator frame 40 about axis 46. A position B on a vertical longitudinal plane indicates the approximate position of the center of mass of a user sitting on seat 60. Position B is approximately above the position where rockers 11 and 12 contact a floor surface 100. An angle J is a reference angle between floor surface 100 and a forward portion of seat 60.

Figure 4:
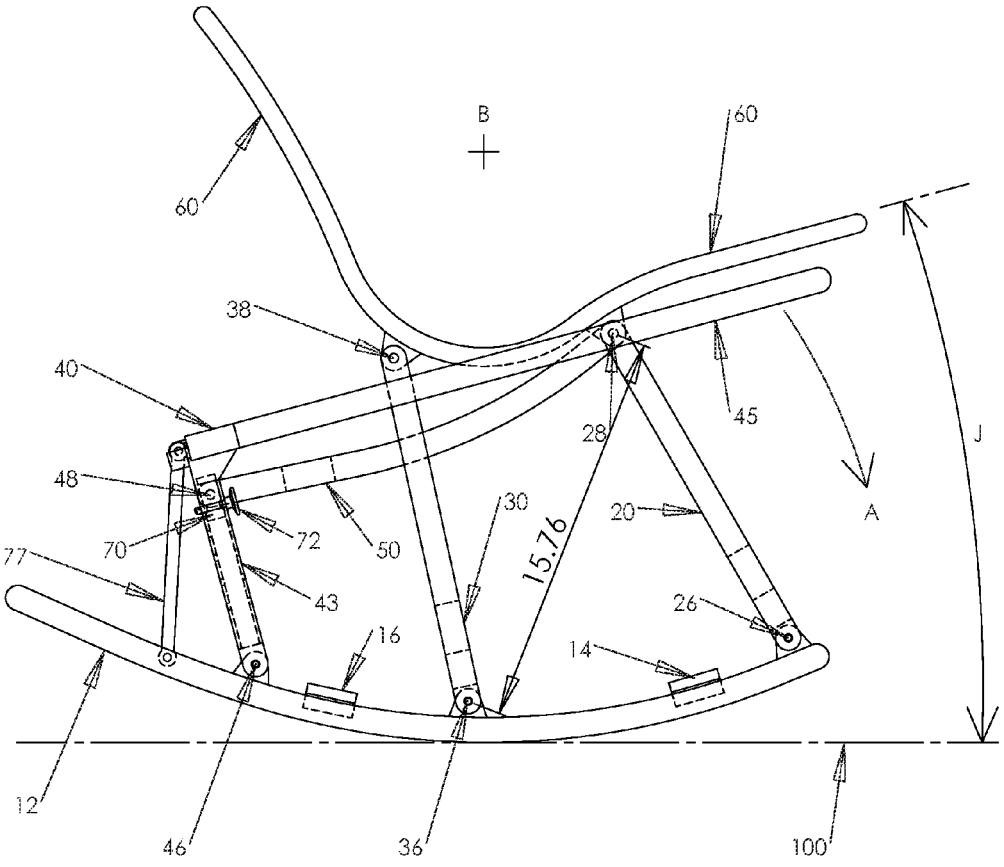
FIG. 4 is a transparent side plan view of the chair in a final load position and a maximum resistance setting.

FIG. 4 is a transparent side elevation view with the chair in a final load position with an axis 48 position that provides maximum resistance to user actuation. Angle J in the FIG. 4 position is approximately equal to angle J in the FIG. 3 position.

In the preferred embodiment, the geometric relationship between axes 26, 28, 36, and 38 is as follows. The axis 26 to axis 28 distance is 14.0 inches. The axis 36 to axis 38 distance is also 14.0 inches. The axis 26 to axis 36 distance 13.0 inches. The axis 28 to axis 38 distance is 8.8 inches. In the initial no-load position and high resistance axis 48 position of FIG. 3, the diagonal distance between axis 28 and 36 is 10.8 inches. In the final load position and high resistance pin 72 position of FIG. 4, the diagonal distance between axis 38 and axis 26 is 15.8 inches.

In the preferred embodiment, in the high resistance axis 48 position of FIGS. 3 and 4, user actuation from the initial no-load position of FIG. 3 to the final load position of FIG. 4 lifts user center of mass position B approximately 3.2 inches with respect to floor surface 100. The same user actuation moves the user center of mass position B approximately 2.5 inches forward with respect to rocker base 10. Then the resulting rocking motion rolls user center of gravity position B approximately 5.0 inches further forward in space, for a total compound horizontal translation of approximately 7.5 inches in space, assuming slow user actuation without dynamic effects.

In the preferred embodiment, in the no-load position of FIG. 3, the angle in a vertical longitudinal plane between levers 42 and 43 and rockers 11 and 12 is such that user adjustment of blocks 70 towards axis 46 acts to partially pre-elevate seat 60 while handles 44 and 45 remain in the no-load position of FIG. 3.

In the preferred embodiment, the radii of curvature of the surfaces of rockers 11 and 12 that contact floor surface 100 are variable, being shorter in the forward portion of rockers 11 and 12 and longer in the rear portions of rockers 11 and 12. In the preferred embodiment, the radii of curvature of rockers 11 and 12 is 31 inches in an arc segment near and between the floor 100 contact positions in FIGS. 3 and 4. The radius of curvature of rockers 11 and 12 increases to approximately 55 inches reward of that segment. The end portions of rockers 11 and 12 are straight.

4. OPERATION

When seated in the chair, the user grasps some portion of handles 44 and 45 and pushes forward and down in a crunch type motion, causing push frame 50 to push axis 28 upwards and forwards to push seat structure 60 upwards and forwards with respect to rocker base 10. The upward component of this motion provides gravitational resistance. The forward component of this motion initiates a rocking motion in rocker base 10 as a result of the forward motion of the user's body mass. In turn, this results in a further forward motion of the user as rocker base 10 rolls forward on floor surface 100.

The above compound horizontal motion of the user's center of mass assumes slow user actuation with no dynamic effects. However, fast actuation creates user inertia that can increase the amplitude of rocker base 10 oscillations. Moreover, a rocking chair is a harmonic oscillator, so transitory actuation at a frequency close to the natural period of oscillation will further increase amplitude. These dynamic effects provide potential for interesting modes of operation. For example, a user can establish an amplified oscillation by fast actuation, then abruptly change phase to increase resistance in opposition to his or her own inertia. Such dynamics are kinesthetically pleasurable, which provides a subjective user reward for the work done actuating the chair.

During user actuation from the initial no-load position of FIG. 3 to the final load position of FIG. 4, angle J remains approximately constant, so the above compound motion provides an upward and forward gliding sensation. Provision of a more constant angle J also enhances user security in seat 60 during high amplitude oscillations. The provision of larger radii of curvature in the rear portions of rockers 10 and 12 further enhances user security in seat 60.

User placement of pins 72 in holes that are closer to axis 46 reduces resistance to user actuation by reducing the distance between axes 46 and 48, which has the effect of increasing the leverage of handles 44 and 45 on push frame 50. In the preferred embodiment, when axis 48 is set at the minimum resistance position, user actuation of handles 44 and 45 elevates seat 60 by less than one inch with respect to floor surface 100.

The means by which user selection for low resistance pre-elevates seat 60 anticipates the needs of less-strong users, who are most likely to both prefer a low resistance setting and prefer getting into and out of a higher chair 60.

Springs 76 and 77 act to hold rear frame 40 in the no-load position when a user is not seated in the chair and the weight of handles 44 and 45 would otherwise tend to rotate rear frame 40 in direction A.

User actuation of handles 44 and 45 in direction A makes both forward frame 20 and central frame 30 more vertical. The vertical component of the resulting seat 60 movement therefore diminishes in the later portion of handle 44 and 45 rotation, so the static user force required to hold handles 44 and 45 stationary is least at the final load position of FIG. 4. This dynamic, in combination with user selectivity of axis 48 position, can enable users to maintain the final load position for long periods of time, for example while watching television. In this mode of use, the chair provides an upper body isometric exercise when sitting that is commensurate with lower body isometric exercise when standing, which has physiological benefit.

What is claimed is:

1. In an exercise chair, the combination comprising a lower rocker base with an arcuate floor contacting surface that rocks on a floor in a vertical longitudinal plane;

an upper seat in which a user may sit facing in a forward longitudinal direction;

a set of one or more transverse support frames whose lower portions pivotably connect to said rocker base about transverse axes and whose upper portions pivotably connect to said seat about transverse axes;

a set of left hand and right hand user actuator handles whose end portions connect through an actuator frame that pivotably connects to said rocker base about a transverse axis; and an actuation linkage by which user movement of said handles causes said seat to move both vertically and horizontally with respect to said rocker base.

2. An exercise chair as set forth in claim 1 in which two or more said transverse support frames define the motion of said seat with respect to said rocker base in one degree of freedom, and said actuation linkage is an intermediate push frame whose rear portion pivotably connects to said actuator frame about a transverse axis and whose forward portion pivotably connects to said seat about a transverse axis.

3. An exercise chair as set forth in claim 2 in which the position on said actuator frame of the pivot axis with said push frame is user-adjustable to vary actuator frame leverage.

4. An exercise chair as set forth in claim 1 in which there is one said transverse support frame and said actuator frame pivotably connects directly to said seat about a transverse axis.

5. An exercise chair as set forth in claim 1 in which the force of gravity rocks said rocker base forward and back in response to the horizontal movement of said seat with respect to said rocker base.

6. An exercise chair as set forth in claim 5 in which the user can actuate change in the angle between said seat and said rocker base which is approximately equal and opposite to the change in angle between said rocker base and said floor during slow actuation, so that the angle between said seat and said floor is substantially constant during slow actuation.

* * * * *